United States Patent [19]

Litchfield

[11] 4,439,816

[45] Mar. 27, 1984

[54] LIGHTING AND AIR FILTER STRUCTURE

[75] Inventor: Philip F. Litchfield, Edina, Minn.

[73] Assignee: Sci-Med Environmental Systems, Inc., Eden Prairie, Minn.

[21] Appl. No.: 329,185

[22] Filed: Dec. 10, 1981

[51] Int. Cl.[3] ..... F21V 33/00

[52] U.S. Cl. ..... 362/96; 362/253; 362/294; 362/297; 362/298; 362/345; 362/346; 362/218; 362/373

[58] Field of Search ..... 362/74, 96, 253, 346, 362/398, 218, 294, 297, 298, 345, 373

[56] References Cited

U.S. PATENT DOCUMENTS

| | | | |
|---|---|---|---|
| 2,471,954 | 5/1949 | Harvey | 362/346 X |
| 2,564,334 | 8/1951 | Kennedy . | |
| 2,845,855 | 8/1958 | Burns . | |
| 3,090,434 | 5/1963 | Benson, Jr. et al. | 362/218 X |
| 3,103,156 | 9/1963 | Quin | 362/218 X |
| 3,107,863 | 10/1963 | Potapenko | 362/96 |
| 3,117,509 | 1/1964 | Archer et al. | 362/218 X |
| 3,403,614 | 10/1968 | Carnes . | |
| 3,418,915 | 12/1968 | Marble . | |
| 3,419,714 | 12/1968 | Slauer . | |
| 3,570,385 | 3/1971 | Heisterkamp et al. . | |
| 3,838,268 | 9/1974 | Fabbri . | |
| 3,841,206 | 10/1974 | Meckler | 362/218 X |
| 3,846,072 | 11/1974 | Patterson | 362/218 X |

FOREIGN PATENT DOCUMENTS

| | | | |
|---|---|---|---|
| 1115656 | 10/1961 | Fed. Rep. of Germany | 362/348 |
| 1952197 | 4/1970 | Fed. Rep. of Germany | 362/218 |
| 2707143 | 8/1978 | Fed. Rep. of Germany | 362/348 |

*Primary Examiner*—Peter A. Nelson

*Attorney, Agent, or Firm*—James R. Haller

[57] ABSTRACT

A lighting and air filter structure for use in clean rooms and the like. The structure includes a housing with upstream and downstream sides and through which air is flowed, the filter carried by the housing to filter the air, a plurality of lights carried by the housing downstream of the filter, and reflector means comprising a plurality of parallel, elongated reflector plates and carried between the filter and the lights. The plates are spaced in the direction of air flow from one another to provide air flow ports, and the reflector plates cause no significant pressure drop thereacross.

13 Claims, 5 Drawing Figures

LIGHTING AND AIR FILTER STRUCTURE

TECHNICAL FIELD

The invention is within the technical field relating to filter structures of the type used to filter air used in, for example, "clean rooms" of the type used for assembling electronic devices, for hospital use, and the like.

BACKGROUND ART

Filters that are used to filter air for use in clean rooms commonly are referred to as "HEPA" filters, and are capable of removing even very small dust particles and microorganisms from the air flow. HEPA filters, supplied commercially in the form of porous sheets or plates, are common to the industry, and need not be described further. Clean rooms often have filter assemblies including housings containing HEPA filters installed in ceilings, with the filtered air thus issuing into clean rooms exiting through exhaust ports located generally at floor level around the peripheries of the rooms.

It is generally desirable to locate the lighting fixtures for clean rooms at or near the ceilings. Inasmuch as filter sheets or plates such as the HEPA filters are light-absorbing, only a portion of the light emitted by lights carried beneath the filters is useable. As a result, high-powered lights must be used so that the light which reaches the work level is sufficiently intense to enable workers to appropriately perform their duties. As a result, much energy is wasted in lighting such rooms.

The air issuing from ceiling-mounted filters desirably is maintained in laminar flow throughout the room, and the flow of air from the filters desirably is, at least initially, directed vertically downwardly. Were closely positioned reflectors of known design to be employed beneath the filters and above the lights to reflect light downwardly into a clean room, the air from the filters would have to somehow pass around or through the reflectors, thereby causing an interruption in air flow and further involving a likely significant pressure drop across the reflectors.

U.S. Pat. No. 3,570,385 discloses a modular panel system for clean rooms, as does U.S. Pat. No. 3,418,915. Other patents showing various lighting structures are U.S. Pat. Nos. 3,403,614, 2,564,334, 3,090,434, 3,838,268, 3,419,714 and 2,845,855.

DISCLOSURE OF INVENTION

The present invention provides a lighting and air filter structure which includes reflector means for reflecting light from the lights away from a filter, and which on the one hand provides significant light reflection as to reduce lighting energy requirements, but which on the other hand does not significantly interfere with or cause a significant pressure drop in air passing through the reflector means.

The structure includes a housing having air inlet and exhaust ports defining upstream and downstream sides through which air to be filtered flows, air filter means disposed in the housing to filter air passing therethrough, and lighting means comprising a plurality of lights carried by the housing downstream of and spaced from the filter means. The invention is characterized by reflector means comprising a plurality of parallel, elongated reflector plates carried by the housing between the filter means and the lighting means, with adjacent reflector plates being spaced from one another in the direction of air flow to permit air issuing from the filter to pass between the reflector plates without significant pressure drop, the reflector plates having reflective, downstreamfacing surfaces.

The lights are preferably elongated (typified by commercial fluorescent lamps) and are positioned parallel to one another and substantially at right angles to the longitudinal direction of the parallel reflector plates. The reflector plates nearer the air filter desirably are generally "V" or "U" shaped in cross-section with legs of the shapes diverging in the downstream direction.

The reflector plates desirably are arranged in two layers with respect to the direction of air flow with edges of the plates in the layer nearest the filter substantially aligned in the direction of air flow with edges of the adjacent plates of the other layer. The structure preferably includes means defining an air flow direction grid comprising a plurality of elongated, directional control vanes carried by the housing downstream of the lighting means and arranged at right angles to one another and to the direction of air flow.

BEST MODE FOR CARRYING OUT THE INVENTION

Figure 1:
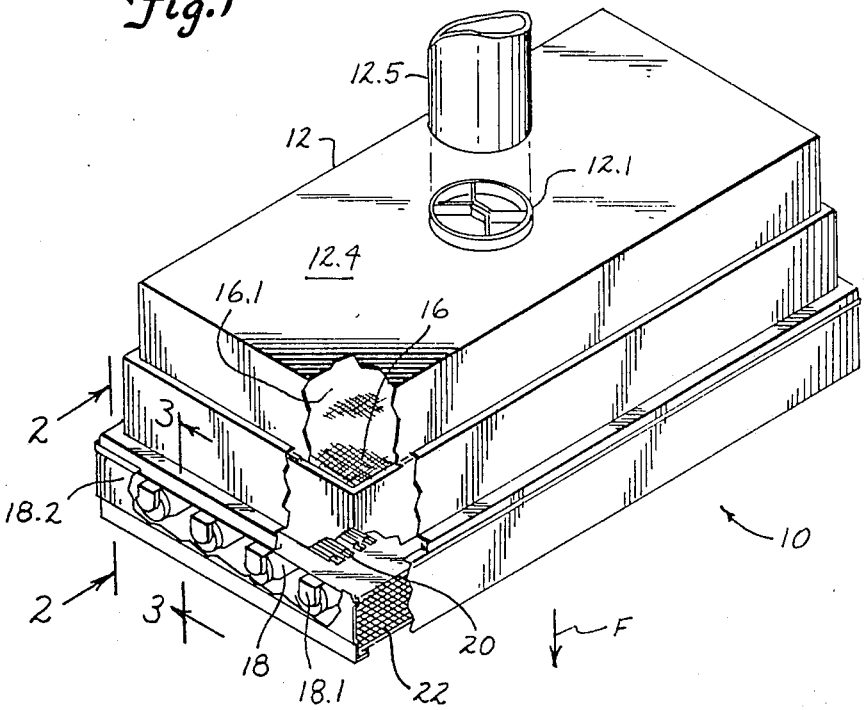
FIG. 1 is a perspective view, shown partially broken away, of a lighting and air filter structure of the invention.
Figure 2:
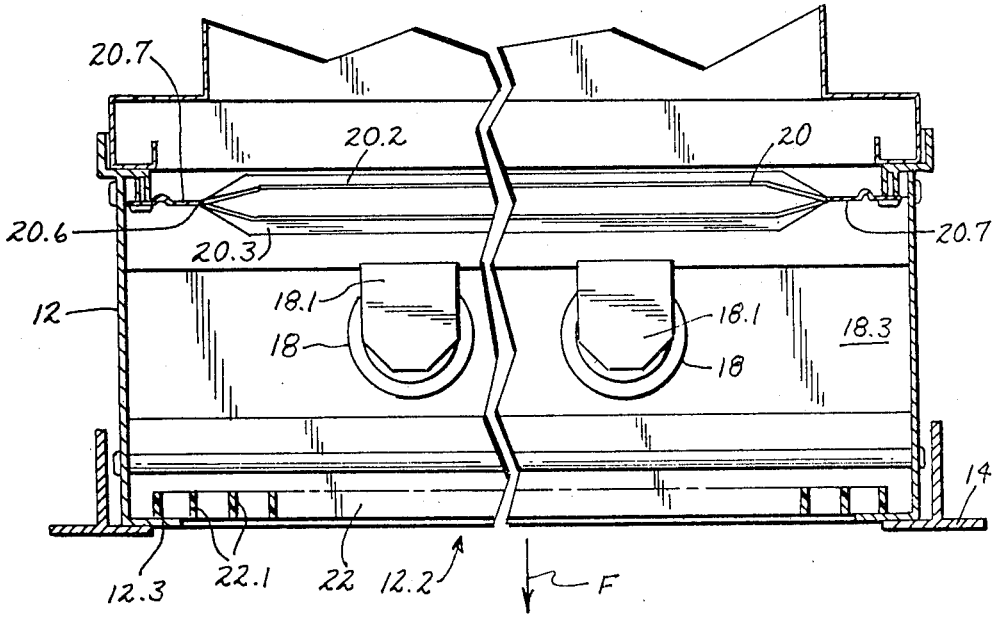
FIG. 2 is a broken-away, cross-sectional view taken generally along line 2—2 of FIG. 1.
Figure 3:
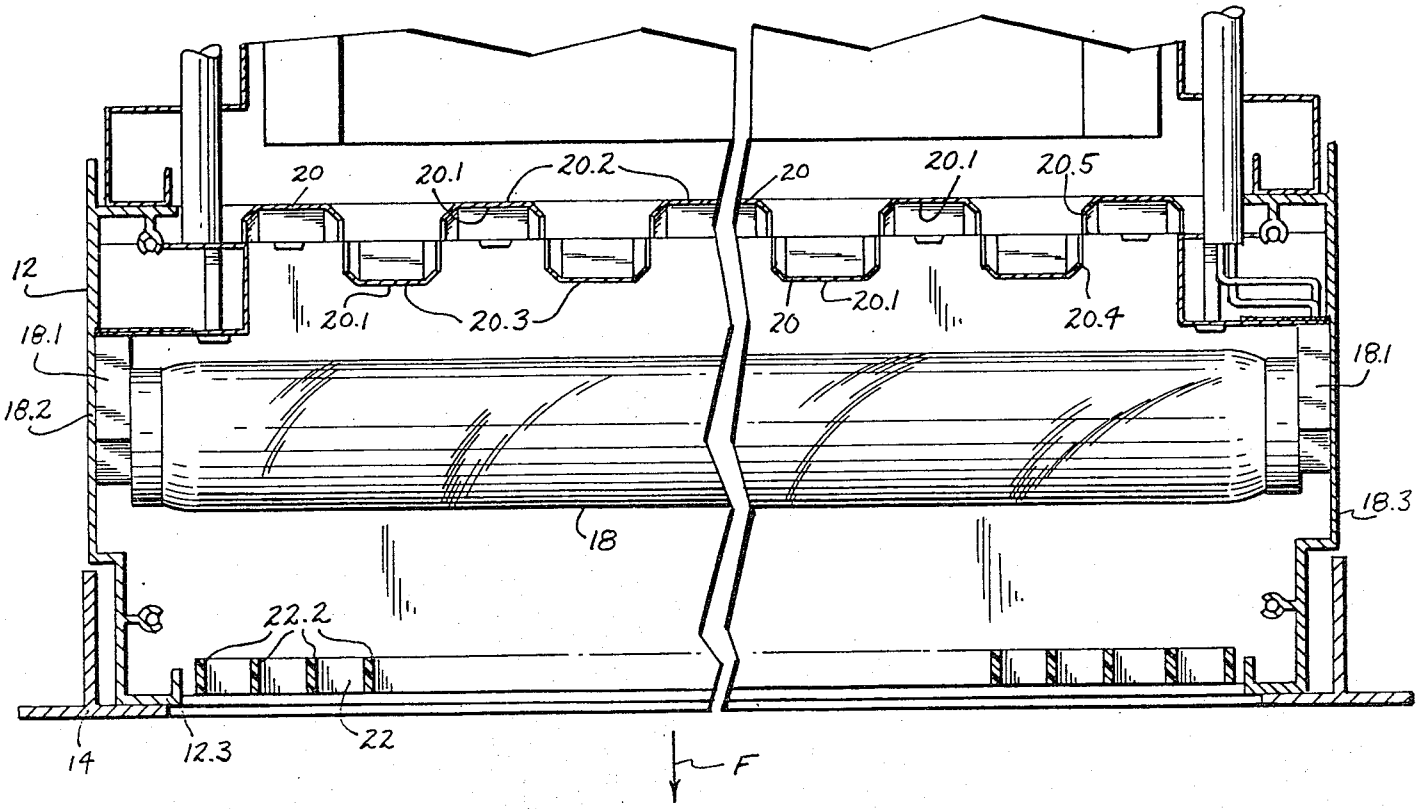
FIG. 3 is a broken-away, cross-sectional view taken generally along line 3—3 of FIG. 1.

Referring to FIGS. 1–3 and particularly to FIG. 1, an embodiment of the invention is designated generally as 10 and includes a housing (12) having an air intake port (12.1) and a wide air exhaust port (12.2). As depicted, the housing (12) is generally parallelepiped in shape, with substantially its entire downstream or lower face (12.3) being open for air flow. The air intake port (12.1) located on the upstream or upper face (12.4) of the housing generally is adapted to receive an air supply tube (12.5). A generally rectangular mounting flange (14) may be mounted to the ceiling of a clean room in which the structure is to be used, with the periphery of the housing resting downwardly upon and being supported by the flange (14).

An air filter, such as the well-known "HEPA" filter, is designated as (16) in FIGS. 1 and 3, and is retained in the housing by means of standard brackets or other well-known attachment means. The filter itself is desireably spaced below the upstream face (12.4) of the housing to provide a cavity (16.1) enabling air entering the housing through the port (12.1) to flow across the surface of the filter. Air filters of the type described are well known in the field, as are means for mounting the same within housings, and no further description thereof is needed.

Mounted near the downstream face (12.3) of the housing are a plurality of lights, typified in the drawing as standard elongated fluorescent lamps (18). Standard fluorescent lamp connectors (18.1) are attached to respective, opposed end walls (18.2, 18.3) of the housing, as shown in the drawing, the lamps (18) thus being supported and extending in a spaced, parallel relationship to one another across the interior of the housing and normal to the direction of air flow. Direction of air flow is shown by arrow "F" in the drawing.

A plurality of elongated, parallel reflector plates (20), typifying reflector means, extend across the interior of the housing between the filter (16) and the lamps (18). The reflector plates are provided with reflective downstream-facing surfaces (20.1) for reflecting light emitted by the lamps (18). The reflector plates preferably have their longitudinal direction generally perpendicular to the longitudinal direction of the lamps (18), and preferably are arranged in two layers normal to the direction of air flow. The upper layer of reflector plates, characterized by plates (20.2) in FIG. 3, lie in generally a transverse plane adjacent the filter (16). The other layer of plates, typified by plates (20.3), are parrell to plates (20.2) but lie generally in a plane spaced beneath the plane of the filter plates (20.2). The longitudinal edges of each reflector plate thus are spaced in the direction of air flow from the longitudinal edges of the adjacent reflector plates, as shown in the drawing.

As shown best in FIG. 3, the adjacent longitudinal edges (20.4, 20.5) of adjacent reflector plates are substantially aligned in the direction of air flow. In this manner, the plurality of reflector plates presents substantially complete, unbroken reflector surface facing in the direction of air flow. The ends (20.6) of the reflector plates may be attached to opposed walls of the housing by any convenient means as by riveting.

In a preferred embodiment, the reflector plates are formed from a single sheet of material by a metalforming procedure that maintains a generally unbroken end portion (shown at 20.7 in FIG. 2) that can be attached to side walls of the housing by known means such as that depicted in FIG. 2. In this embodiment, the sheet of material is formed into longitudinal strips, each strip being appropriately formed in cross-section and each strip being spaced from adjacent strips in the direction of air flow.

One desired cross-sectional configuration of the reflector plates is the generally "U" shape shown in FIG. 3, the legs (20.8) of the "U" shape of the layer of reflector plates nearer the filter (16) diverging in the direction of air flow. The legs of the cross-sectional shape of the other layer may diverge in the upstream direction, as shown, or may diverge in the downstream direction, as desired. It will be understood that the reflector plates may be formed as separate pieces, and each may be fastened, in the described configuration, within the housing.

Figure 4:
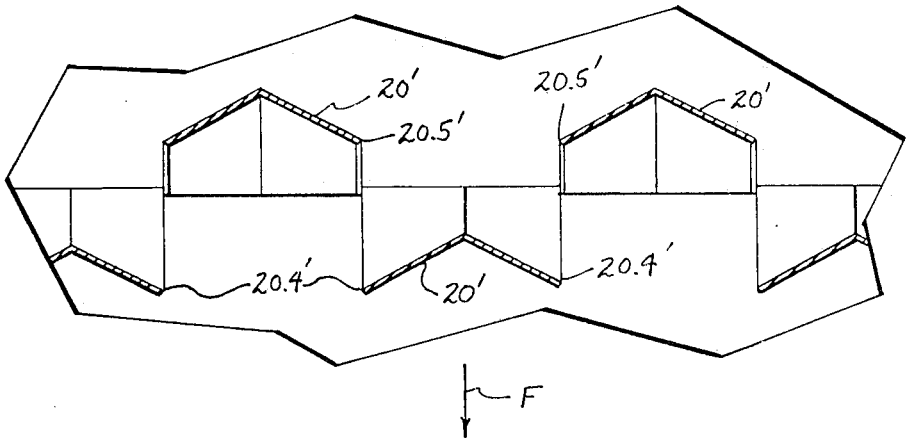
FIG. 4 is a broken-away, cross-sectional view showing a modified cross-sectional shape of reflector plates employed in the structure of FIG. 1.
Figure 5:
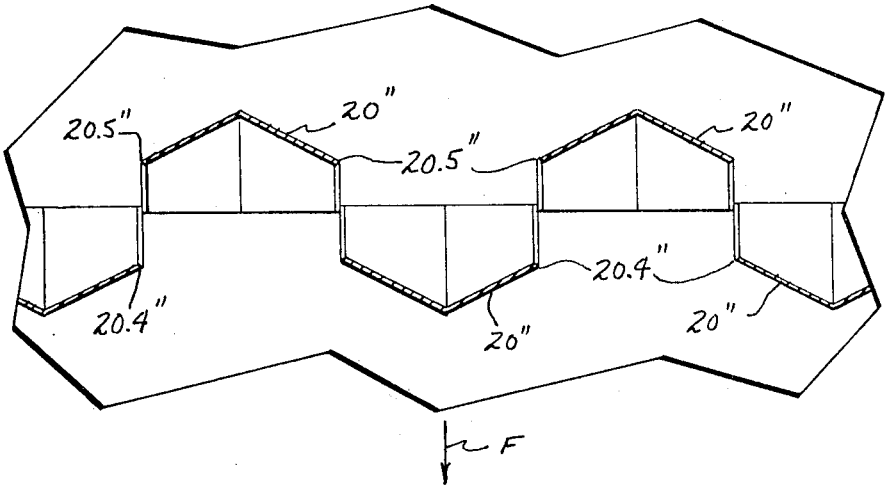
FIG. 5 is a broken-away, cross-sectional view similar to that of FIG. 4 but showing another cross-sectional configuration of reflector plates.

Alternative cross-sectional configurations of the reflector plates (20) are shown in FIGS. 4 and 5, the reflector plates being designated (20') in FIG. 4 and (20'') in FIG. 5. For ease of explanation, it may be assumed that the reflector plates (20') and (20'') are identical to those shown in FIG. 3 except for the cross-sectional configurations of the plates. The reflector plates 20' of FIG. 4 have a generally "V" cross-sectional configuration with the apex of the "V" in both the upper and lower layers of plates pointing in an upstream direction. FIG. 5 is different from FIG. 4 in that the apex of the "V" configuration of the reflector plates in the downstream layer point generally downstream. As with the embodiment shown in FIG. 3, the longitudinal edges of adjacent reflector plates (20.4', 20.5' in FIG. 4 and 20.4'', 20.5'' in FIG. 5) are spaced from one another in the direction of air flow, and preferably are generally aligned in the direction of air flow to present a generally uninterrupted reflective surface.

It has been found that good results are obtained by employing reflector plates that have a width of about 2.54 cm and in which longitudinal edges of adjacent plates are spaced from one another in the direction of air flow by approximately 1.27 cm. The area of the plurality of reflector plates should be at least the same or greater than the area occupied by the lights.

Carried by the housing, and spaced beneath the lamps (18), is an air flow direction grid designated generally as (22), the grid comprising formed, transverse air vanes (22.1, 22.2) extending at right angles to one another across the housing and forming a grid pattern such as that shown in FIG. 1. The vanes (22.1), (22.2) form generally square openings of about 1 cm on a side, and the vanes themselves serve to aid in the straightening of the air flow pattern so that the same proceeds substantially vertically when emitted from a ceiling installation.

A lighting and air filter structure of the invention having separate reflector plates of the type shown in FIG. 5 was prepared. The distance, measured transverse to the direction of air flow, from one longitudinal edge to the other of each plate was 2.54 cm, and the adjacent, longitudinal edges of adjacent reflector plates were spaced in the direction of air flow by a distance of 1.27 cm. Light intensity readings were taken at a distance of 1.57 meters below the structure in an area measuring 76.2 cm by 152.4 cm. The latter area was then divided into twelve equal segments each having dimensions of 25.4 cm by 38.1 cm, and the light intensity readings were taken in the middle of each area segment. The average intensity of light within the measurement area was 65.8 foot-candles. A comparative measurement was made in the absence of the reflective plates, and yielded an average value of 47.8 foot-candles.

Air was forced downwardly by an electrically powered blower through the structure, both with and without the reflector plates, the speed of air issuing from the structure being maintained at 100 feet per minute and the power requirements of the blower being measured. The power requirement for the structure without the reflector plates was 318 watts, and, with the reflector plates, was 326 watts. The wattage difference was well within the margin of experimental error, and it can hence be deduced that there was no significant pressure drop across the reflector plates. Air direction was observed downstream from the structure using a smoke tell-tale, and it was observed that the structure including the reflector plates as shown in FIG. 5 provided a smooth, laminar, downward flow of air.

While a preferred embodiment of the present invention has been described, it should be understood that various changes, adaptations and modifications may be made therein without departing from the spirit of the invention and the scope of the appended claims.

I claim:

1. A lighting and air filter structure comprising a housing having air inlet and outlet ports defining upstream and downstream sides of the housing, an air filter disposed in the housing for filtering air passing therethrough, lighting means comprising a plurality of lights carried by the housing downstream of and spaced from the filter means, and reflector means comprising a plurality of parallel, elongated reflector plates carried by the housing and oriented generally normal to the direction of air flow and between the air filter and the lights, adjacent reflector plates being spaced from one another in the direction of air flow and having adjacent edges substantially aligned in the direction of air flow to permit air issuing from the filter to pass between the reflector plates without significant pressure drop, the reflector plates having reflective, downstream-facing surfaces to reflect light emitted by the lighting means away from the air filter.

2. The structure of claim 1 in which said lights are elongated and parallel and are positioned substantially at right angles to the longitudinal direction of the reflector plates.

3. The structure of claim 1 in which the reflector plates nearest the air filter are generally "V" or "U" shaped in cross-section with legs of the "V" or "U" shapes diverging in the direction of air flow.

4. The structure of claim 1 wherein the reflector plates are arranged in two layers generally normal to the direction of air flow with edges of the plates in the layer nearest the filter substantially aligned with adjacent edges of the reflector plates of the other layer.

5. The structure of claim 1 wherein adjacent edges of adjacent reflector plates are substantially aligned in the direction of air flow to provide a substantially unbroken, downstream-facing reflective surface.

6. A lighting and air filter structure for use in clean rooms and the like and comprising a housing mountable to the ceiling of a clean room and having air inlet and outlet sides defining upstream and downstream directions, respectively, of air flow therethrough, an air filter disposed in the housing for filtering air passing downwardly therethrough; lighting means comprising a plurality of elongated, parallel lights carried by the housing and vertically spaced below the filter means, and reflector means comprising a plurality of parallel, elongated reflector plates carried by the housing between the air filter and the lights adjacent reflector plates being spaced from one another vertically in vertically spaced layers, and longitudinal edges of adjacent reflector plates being substantially vertically aligned to define elongated apertures through which air issuing from the air filter may pass without significant pressure drop, the reflector plates having reflective, downwardly-facing surfaces and presenting a substantially unbroken reflective surface for reflecting light from the lights in a generally downward direction.

7. The structure of claim 6 in which the reflector plates are arranged in two vertically spaced layers with edges of the plate in the uppermost layer substantially aligned with adjacent edges of the plates in the lower layer.

8. The structure of claim 7 in which the reflector plates in the upper layer are generally "V" shaped in cross-section with legs of the "V" diverging downwardly.

9. The structure of claim 7 in which the reflector plates in the upper layer are generally "U" shaped in cross-section with legs of the "U" diverging downwardly.

10. The structure of claim 7 in which the vertical spacing between adjacent longitudinal edges of adjacent reflector plates is on the order of 1.37 cm.

11. The structure of claim 1 in which the reflector plates are formed from a single sheet of material providing the plates with common end attachment means, and wherein the housing has opposed side walls to which said attachment means are attached.

12. A lighting and air filter structure comprising a housing having air inlet and outlet ports defining upstream and downstream sides of the housing, an air filter disposed in the housing for filtering air passing therethrough, lighting means comprising a plurality of lights carried by the housing downstream of and spaced from the filter means, and reflector means comprising a plurality of parallel, elongated reflector plates between the air filter and the lights and carried by the housing in two layers extending generally normal to the direction of air flow, adjacent reflector plates being spaced from one another in the direction of air flow and having adjacent edges substantially aligned in the direction of air flow to permit air issuing from the filter to pass between the reflector plates without significant pressure drop, the reflector plates having reflective, downstream-facing surfaces to reflect light emitted by the lighting means away from the air filter.

13. The lighting and air filter structure of claim 12 in which the reflector plates are formed from a single sheet of material providing the plates with common end attachment means, and wherein the housing has opposed side walls to which said attachment means are attached.

* * * * *